US010511124B2

(12) United States Patent
Wittmann

(10) Patent No.: US 10,511,124 B2
(45) Date of Patent: Dec. 17, 2019

(54) ELECTRICAL PLUG CONNECTION

(71) Applicant: Robert Bosch GmbH, Stuttgart (DE)

(72) Inventor: Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/073,994

(22) PCT Filed: Jan. 23, 2017

(86) PCT No.: PCT/EP2017/051265

§ 371 (c)(1),
(2) Date: Jul. 30, 2018

(87) PCT Pub. No.: WO2017/129501

PCT Pub. Date: Aug. 3, 2017

(65) Prior Publication Data

US 2019/0044280 A1 Feb. 7, 2019

(30) Foreign Application Priority Data

Jan. 29, 2016 (DE) ..... 10 2016 201 385

(51) Int. Cl.
*H01R 13/62* (2006.01)
*H01R 13/629* (2006.01)
*H01R 107/00* (2006.01)

(52) U.S. Cl.
CPC . *H01R 13/62911* (2013.01); *H01R 13/62938* (2013.01); *H01R 2107/00* (2013.01); *H01R 2201/26* (2013.01)

(58) Field of Classification Search
CPC ..... H01R 13/6211; H01R 13/62938; H01R 2107/00

(Continued)

(56) References Cited

U.S. PATENT DOCUMENTS 5,928,011 A * 7/1999 Flask ..... H01R 13/4362 439/157
5,928,013 A * 7/1999 Iwahori ..... H01R 13/62905 439/157

(Continued)

FOREIGN PATENT DOCUMENTS

CN 1213872 A 4/1999
CN 102341968 A 2/2012

(Continued)

OTHER PUBLICATIONS

International Search Report for PCT/EP2017/051265 dated Apr. 13, 2017.

*Primary Examiner* — Alexander Gilman
(74) *Attorney, Agent, or Firm* — Norton Rose Fulbright US LLP; Gerard Messina

(57) ABSTRACT

An electrical plug connection includes a plug including a housing with a plurality of electrical plug contacts and including an operating element moveably fastened on the housing and including a sliding track that includes first and second sections oriented such that plugging the plug into the plug module or detaching the plug from the plug module is carried out by two movements of the operating element that are in two opposite movement directions; and a plug module with a plurality of complementary plug contacts that electrically contact the electrical plug contacts in a plugged-in position and attached to a pin that is guided in the track. During a movement of the operating element relative to the housing, a force is transmittable from the sliding track to the pin so that the plug and plug module move toward each other or move away from each other.

10 Claims, 4 Drawing Sheets

(58) Field of Classification Search
USPC ..... 439/157
See application file for complete search history.

(56) References Cited

U.S. PATENT DOCUMENTS

| | | | | |
|---|---|---|---|---|
| 6,997,725 | B2 * | 2/2006 | Stella | H01R 13/453 439/157 |
| 8,235,742 | B2 * | 8/2012 | Komiyama | H01R 13/62977 439/157 |
| 9,153,909 | B2 * | 10/2015 | Takatsu | H01R 13/62905 |
| 9,564,710 | B2 * | 2/2017 | Ebihara | H01R 13/62938 |
| 2003/0109166 | A1 * | 6/2003 | Ookura | H01R 13/5202 439/372 |
| 2011/0250771 | A1 * | 10/2011 | Suzuki | H01R 13/62933 439/157 |

FOREIGN PATENT DOCUMENTS

| | | | |
|---|---|---|---|
| CN | 102629720 | A | 8/2012 |
| DE | 19714947 | A1 | 11/1997 |
| DE | 102007034569 | A1 | 2/2009 |
| DE | 102013222959 | A1 | 5/2015 |
| EP | 0606152 | A2 | 7/1994 |
| EP | 2804268 | A1 | 11/2014 |
| JP | H0654255 | U | 7/1994 |
| WO | 02078126 | A2 | 10/2002 |

* cited by examiner

ELECTRICAL PLUG CONNECTION

CROSS-REFERENCE TO RELATED APPLICATIONS

The present application is the national stage of International Pat. App. No. PCT/EP2017/051265 filed Jan. 23, 2017, and claims priority under 35 U.S.C. § 119 to DE 10 2016 201 385.8, filed in the Federal Republic of Germany on Jan. 29, 2016, the content of each of which are incorporated herein by reference in their entireties.

FIELD OF THE INVENTION

The present invention relates to a plug and an electrical plug connection including a plug and a plug module, which can be used, for example, for connecting a wiring harness to an electrical device.

BACKGROUND

Structural operating elements for transmission of force are used to achieve the ergonomic specifications for the operating forces for joining electrical plug connections, in particular multipolar plug connections. Levers, slides, or a combination of both elements, which interlock, are typical here.

The operating elements can have sliding tracks, in which one or more pins on the collar of the plug module engage. A preferably high transmission ratio during the transformation of the plug-in movement of the plug into the plug module into the movement on the operating element (at a lever end or a slide handle, for example) with corresponding reduction of the maximum actuating force is achieved by a favorable design of the sliding tracks.

The force transmission is frequently restricted in practice via the available installation space and, linked thereto, the available actuating path of the operating element.

DE 19 651 436 A1 shows a plug system, in which, to plug a plug onto a corresponding counterpart, a slidably supported slide having an inclined running or sliding surface is provided on the plug and on the counterpart, for drawing the slide onto the counterpart.

SUMMARY

Example embodiments of the present invention can advantageously enable a high joining force to be generated in a plug connection by transmission via an operating element. The plug connection and in particular the operating element only require a small amount of installation space. In other words, with equal installation space, a lower operating force than in conventional systems is achievable with equal force which is available for the plugging, or with equal operating force, the installation space which is to be provided for the operating element can be reduced. A maneuvering space for operating the operating element is to be included with the installation space.

An example embodiment of the present invention relates to an electrical plug connection made up of this plug and a plug module. The electrical plug connection can be used, for example, for connecting a wiring harness to an electrical device. For example, the electrical plug connection can be used in a motor vehicle, such as a passenger automobile, a truck, or a bus.

According to an example embodiment of the present invention, the electrical plug connection includes a plug having a housing that has a plurality of electrical plug contacts, and a plug module having a plurality of complementary plug contacts that electrically contact the electrical plug contacts in a completely plugged-in position of the plug on the plug module. The plug connection can be a multipolar plug connection, i.e., it can have a multitude of plug contacts. Both the plug and the plug module can each have a housing, in which the plug contacts are supported and/or which is generally manufactured from plastic.

The plug can be guided in the plug module in such a way that the plug is only movable in the plug-in direction or opposite to the plug-in direction between an applied position and a completely plugged-in position. In the applied position, the plug can be applied to a collar of the plug module (the electrical contacts of the plug and the plug module not being in electrical contact). In the completely plugged-in position, the plug can be pushed in and/or over the collar up to a stop (the electrical plug contacts of the plug and the plug module then being in electrical contact).

Furthermore, the plug includes an operating element, which is moveably fastened on the housing of the plug, and which has a sliding track, in which a pin attached to the plug module is guided or is guidable, during a movement of the operating element in relation to the housing, a force being transmitted from the sliding track to the pin, so that the plug and the plug module are moved toward each other in a plug-in direction or away from one another opposite to the plug-in direction. The operating element can be slidable and/or twistable in relation to the plug. Furthermore, the operating element can have a handle, which can be used by an operator to move the operating element. Alternatively thereto, the operating element can be set into motion indirectly via a further element, such as a lever.

The movable fastening of the operating element on the housing can be designed in such a way that the operating element is linearly displaceable in relation to the housing and/or is displaceable rotatably in relation to the housing. This can be implemented, for example, by a groove or a slotted link, in which the operating element is fastened on the housing, or by a rotational axis. The operating element is thus fastened on the housing and can transmit forces and at the same time is displaceable or movable in relation to the housing. In this way, a force effect of the operating element can thus be transmitted from the sliding track of the operating element to the pin. This force can be deflected in another direction or experience a step-up transmission or also step-down transmission by way of the interaction of pin and sliding track. Since the operating element is fastened on the housing, the changed direction of the force is therefore transmitted to the housing, which is therefore moved or displaced in this transformed force direction in relation to the pin and thus the plug module.

A sliding track can be a depression and/or path in or on the operating element, which is delimited by two walls extending essentially in parallel. The pin guided by the sliding track can have a diameter which is essentially equal to the distance of the walls extending in parallel. The pin can be round, but can also have parallel outer faces, which are guided by the parallel walls.

The operating element can be understood as a transmission element of the plug, which mechanically converts a movement of an operator into a plug-in movement. The sliding track is used to convert the movement of the operating element into a movement of the plug in the plug-in direction.

The sliding track has at least one first section and one second section, which are oriented in such a way that plugging the plug into the plug module in the plug-in direction (for example, from the applied position to the completely plugged-in position) is carried out by two movements of the operating element in a first movement direction and a second, opposing movement direction. The operator thus has to move the operating element in the first movement direction, the pin being located in the first section and the plug being pushed by a first part into the plug module. Thereafter, when the pin enters the second section, the operator has to reverse the movement direction, and the plug is then pushed a further part into the plug module.

Conversely, the first section and the second section are oriented in such a way that detaching the plug from the plug module opposite to the plug-in direction (for example, from the completely plugged-in position to the applied position) is also carried out by two movements of the operating element in the second movement direction and the first movement direction.

In this way, the actuating path (i.e., the path which the operating element covers during the plugging in or the detaching of the plug) can be at least doubled, the installation space of the plug being able to be essentially maintained. For example, with equal lever arm of a lever as the operating element, the mechanical transmission ratio of the sliding track in relation to the pin can be doubled if the actuating path of the lever is doubled (back-and-forth movement of the operating element).

This can be carried out by dividing the sliding track into at least two successive sections, through which the pin can travel in different directions. It is possible that the sliding track has more than two sections and the movement of the operating element in the first direction and the second direction has to be carried out more than once in order to completely plug in or detach the plug.

The plugging in or the detaching of the plug can be carried out by a back-and-forth movement of the operating element. The total actuating path and thus the mechanical transmission ratio can therefore be substantially increased, without this making a corresponding enlargement of the installation space necessary.

Because the starting position and the end position of the operating element can be identical, the plug including the operating element can also be transported and delivered in this position, which can save space during transportation. Furthermore, an installer therefore advantageously also does not have to move the operating element into an "open" position prior to the installation.

According to an example embodiment of the present invention, during a movement in the first movement direction, the operating element exerts a first force on the pin, which is located in the first section, this first force being oriented opposite to the plug-in direction, for example, so that the plug module is drawn into the plug or so that that the plug is pushed into the plug module. This force can be transmitted, for example, by the mechanical contact between a wall of the sliding track and the pin.

If the plug module is considered to be static and fixed in place, by way of the pin as a counter bearing to the sliding track, the force effect along the operating direction can be transformed by the sliding track into a force in the plug-in direction. In this coordinate system, the plug is therefore drawn with the aid of the sliding track along the pin onto the plug module. Since the operating element is moveably fastened on the housing, the housing does not tilt on the plug module.

After a change of the pin from the first section into the second section, during a movement in the second movement direction, the operating element exerts a second force on the pin, which is located in the second section, this second force being oriented in the same direction as the first force. For example, the second force can also be oriented opposite to the plug-in direction, just the same as the first force during the plugging in.

During a detachment of the plug connection, the first force and the second force can be oriented in the plug-in direction. The plug module is pressed away in relation to the housing by the interaction of the sliding track and the pin. Overall, the first force and/or the second force can thus be oriented either in parallel to the plug-in direction or opposite to the plug-in direction.

According to an example embodiment of the present invention, the first section of the sliding track and the second section of the sliding track are connected via a buckle in the sliding track. At the buckle, the sliding track can be angled and/or can have a flat angle (less than 90°) between the first section and the second section. In this buckle, the pin changes between the first section and the second section. The movement direction of the operating element also changes when the pin is located in the buckle. In or at the buckle, a switch can be provided, which guides the pin out of the first section into the second section and vice versa. The relative angle of the first section in relation to the second section at the buckle can be less than 90°.

According to an example embodiment of the present invention, the operating element is a slide, which is slidable in a slide direction in relation to the housing of the plug. The slide direction can extend transversely or perpendicularly to the plug-in direction. For example, the slide can be guided on the housing with the aid of a groove or slotted link extending transversely and/or perpendicularly to the plug-in direction. The first movement direction and the second movement direction can be parallel in the case of a slide and/or can extend transversely to the plug-in direction. With little available space (above all in the plug-in direction) at the plugging together point, secure plugging is thus advantageously implementable with relatively little force required. This is because the plugging together is carried out by an operating movement transverse to the plug-in direction.

In the case of a slide, the sections of the sliding track can extend at an angle (transverse) to the plug-in direction or at an angle (transverse) to the slide direction or essentially linearly, an angle of the section in relation to the plug-in direction or movement direction determining the mechanical transmission ratio. For example, the angle to the plug-in direction can be in a range from 20° to 80°, preferably from 45° to 75°.

According to an example embodiment of the present invention, the sliding track has a zigzag shape. In other words, the first section and the second section can extend at a positive and a negative angle to the plug-in direction. The sliding track can therefore have the shape of a "V" rotated by approximately +90° or by −90°, i.e., a shape according to a "greater than" (">") or "less than" sign ("<"). The sliding track can thus be manufactured particularly simply. By slightly tilting the zigzag basic shape, i.e., shifting the pivot of the "V" from 90°, for example, 70°-85°, different transmission ratios can be effectuated in the two sections.

According to an example embodiment of the present invention, the operating element includes a plurality of identically formed sliding tracks. For example, a plurality of zigzag basic shapes or a circular segment shape or a cycloid can thus be arranged in succession. The basic shapes can each be connected by buckles, for example. A pin can be attached on the plug module for each sliding track. In this way, the force exerted by the operating element on the plug module can be distributed uniformly transversely to the plug-in direction.

According to an example embodiment of the present invention, the operating element is a lever or includes a lever which is rotatable in relation to the housing of the plug. The lever can be connected to the housing via a rotational axis. The first movement direction and the second movement direction can be a movement direction clockwise and a movement direction counterclockwise in the case of a lever.

The plug connection can also include a lever and a slide, the slide having a sliding track as described above and hereafter. A combination of slide and lever can be used to reduce the plugging force, the lever engaging in a toothed rack integrated into the slide via a gearwheel situated on the rotational axis. The actuating process for the operator would be a change of the lever rotation direction after half of the joining process in this case.

According to an example embodiment of the present invention, the first section and the second section are curved in an arc shape. In the case of a lever, the distance from the rotational axis to the position of the pin in the sliding track determines the transmission ratio between the movement of the lever and the movement of the plug in or opposite to the plug-in direction. Since the rotational axis moves with the plug in relation to the pin during the plugging in or the detaching, a sliding track can have a cycloid shape. With a deviation from this cycloid shape, the first section and the second section can be formed in such a way that a transmission ratio which is variable over the movement path results, for example, to generate a different transmission ratio at or from a specific point of the plugging procedure (at which, for example, the plug contacts come into contact with one another and/or a higher level of friction is present).

In other words, in the cycloid equation $x(y)=r*\arccos((r-y)/r)-SQRT(y*(2r-y))$, a different radius "r" can be selected in the first section than in the second section. For example, in the second section, radius r can be 50% to 75% of radius "r" in the first section.

It is also possible that the first section and/or the second section are curved in a sliding track of a slide and/or have buckles, to generate a different transmission ratio within a section.

According to an example embodiment of the present invention, the first section and the second section are of different lengths. In particular in the case of movement distances of equal length of the operating element in each case in the first and the second movement directions, transmission ratios of different amounts can thus be generated during the movement in the first direction and during the movement in the second direction. For example, in the case of a slide, the first section can have a different angle in relation to the plug-in direction than the second section. In the case of a lever, a distance to the rotational axis of the lever which travels due to the movement of the plug in relation to the pin can be compensated for using sections of different lengths.

However, it is also possible that the first section and the second section have equal lengths.

It is to be understood that an operating element having a sliding track and a corresponding pin can be attached on opposing sides of the plug or the plug module, the sliding tracks extending in parallel to one another on the opposing sides. In this way, a force effect can be distributed uniformly onto the opposing sides of the plug connection.

A further aspect of the present invention relates to a plug for an electrical plug connection, as described above and hereafter. The plug includes a housing having a plurality of electrical plug contacts and an operating element, which is moveably fastened on the housing, the operating element having a sliding track in which a pin is guidable. The sliding track has at least one first section and one second section, which are oriented in different directions. In this way, the plug, as described above, can be plugged into a corresponding plug connection by two reciprocal movements of the operating element.

Further example embodiments of the present invention can be considered to involve, inter alia, the concepts and findings described hereafter.

Example embodiments of the present invention are described hereafter with reference to the appended drawings, which are schematic and are not true to scale, and in which identical reference numerals identify identical or identically acting features, with neither the drawings nor the description to be interpreted as restricting the present invention.

DETAILED DESCRIPTION

Figure 1A:
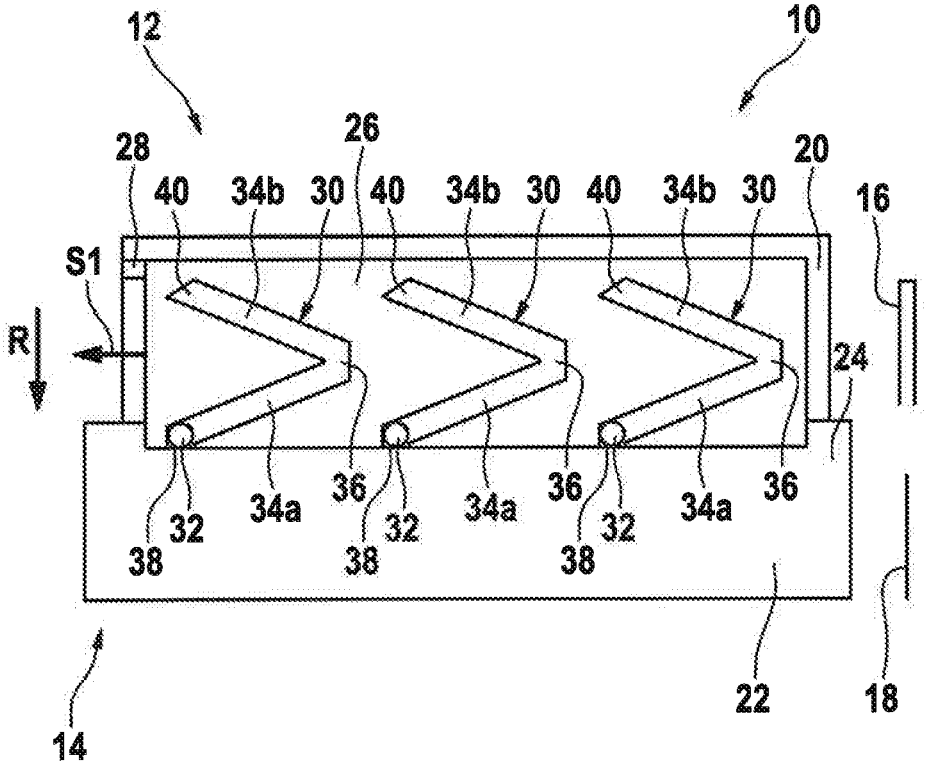
FIG. 1A schematically shows a side view of an electrical plug connection according to an example embodiment of the present invention in an applied position.

FIG. 1 shows an electrical plug connection 10 including a plug 12 and a plug module 14. Plug 12 includes a plurality of plug contacts 16, and plug module 14 includes a plurality of complementary plug contacts 18, which can be brought into electrical contact by plugging plug 12 in a plug-in direction R into plug module 14. For example, plug contacts 18 can be provided in the form of a male multipoint connector.

Plug module 14 is attached, for example to an electrical device and the plug is connected, for example, to a wiring harness. The electrical device can be connected to the wiring harness using electrical plug connection 10.

Plug contacts 16, 18 are schematically shown adjacent to plug 12 and plug module 14. However, plug contacts 16 are located inside a housing 20 of plug 12 and plug contacts 18 are located inside a housing 22 of plug module 14. Housing 22 of plug module 14 includes a collar 24, onto which housing 20 of plug 12 can be plugged and which guides plug 12 in plug-in direction R. The two housings 20, 22 can be manufactured from plastic.

An operating element 26 in the form of a slide 26 is attached to plug 12. Slide 26 is slidable transversely to plug-in direction R and essentially orthogonally to plug-in direction R in relation to housing 20 of plug 12. For example, slide 26 can be guided in a groove 28 in housing 20. Operating element 26 or the slide can be manufactured from plastic.

Operating element or slide 26 has a plurality of sliding tracks 30, which can each be designed as a recess, a depression in operating element 26 or two spaced-apart protrusions on operating element 26. Sliding tracks 30 have a zigzag shape (approximately recumbent "V", i.e., ">" or "<"), are spaced apart equally from one another, and/or extend in parallel to one another.

A plurality of pins 32, which are designed for the purpose of each being guided in one of the sliding tracks, is fastened on collar 24 of housing 22 of plug module 14. Pins 32 are also spaced apart equally from one another.

Embodiments having only one sliding track 30 and one pin 32 are also possible (not shown here).

Each of sliding tracks 30 has a first section 34*a* and a second section 34*b*, which merge into one another at a buckle 36. First section 34*a* has an entry 38, at which particular pin 32 can be inserted into sliding track 30 in a start position and/or merges at its end at buckle 36 into second section 34*b*. Second section 34*b* ends at an end point 40 of sliding track 30, at which pin 32 can no longer be moved further in an end position.

Figure 1B:
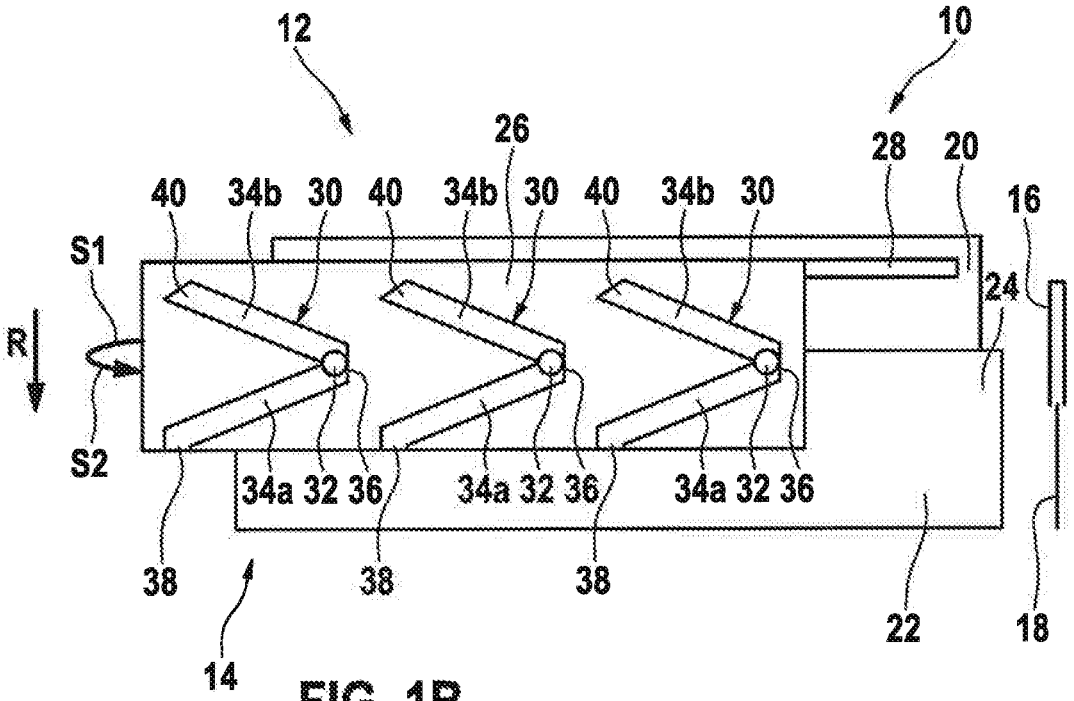
FIG. 1B schematically shows the electrical plug connection from FIG. 1A in a middle position, according to an example embodiment of the present invention.
Figure 1C:
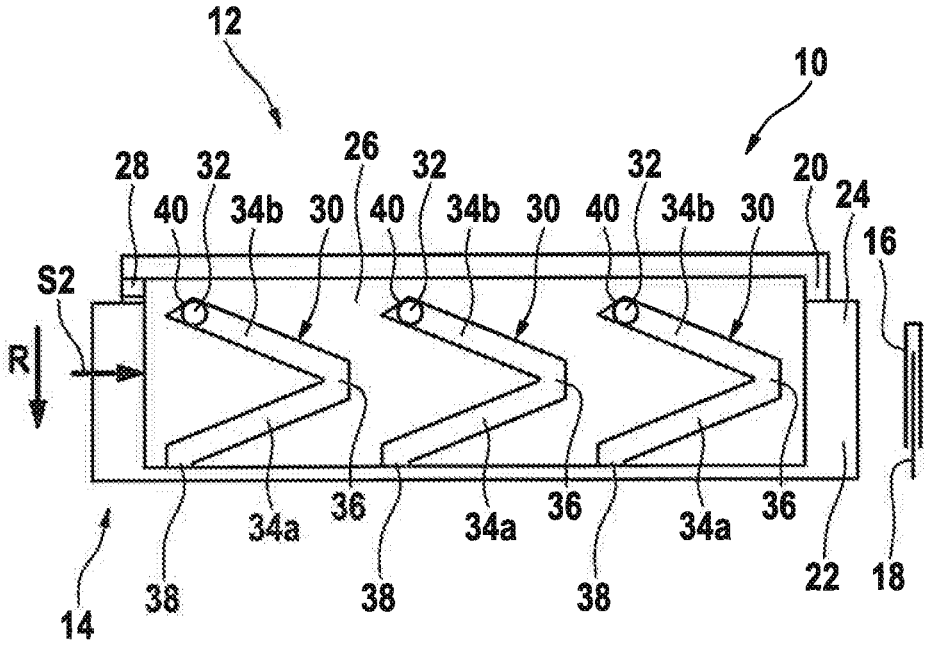
FIG. 1C schematically shows the electrical plug connection from FIG. 1A in a completely plugged position, according to an example embodiment of the present invention.

FIGS. 1A-1C show how plug connection 10 is joined together by actuating slide 26. FIG. 1A shows plug connection 10 in an applied position, in which plug 12 is applied to plug module 14 and pins 32 are located in entry 38 of sliding track 30. Plug contacts 16, 18 are not yet mechanically connected to one another and also not yet electrically connected to one another.

Slide 26 is moved in a first movement direction S1 out of an initial position and moved further up to a middle position. Pins 32 travel along first section 34*a* of sliding track 30 (or sliding track 30 is displaced along pin 32), until they are located at buckle 36, i.e., the transition between first section 34*a* and second section 34*b*, as shown in FIG. 1B. Plug connection 10 is now located in a middle position, in which plug 12 can already be partially inserted into plug module 14, but plug contacts 16, 18 do not yet have to have established an electrical contact. In the middle position, slide 26 is maximally deflected out of the initial position.

After a change of the movement direction of slide 26 from first movement direction S1 to second movement direction S2 opposite to first movement direction S1, the joining process is continued until pins 32, which have traveled through second section 34*b*, have reached end points 40 of sliding tracks 30 in their end position, as shown in FIG. 1C.

Plug connection 10 is located in a completely plugged position, in which plug 12 is inserted maximally into plug module 14 and electrical contacts 16, 18 are electrically contacted. Slide 26 is again located in the initial position, in which it occupies minimal installation space.

Detaching of plug 12 from plug module 14 can be achieved by a movement of operating element 26 or slide 26 opposite to the plugging in of plug 12. The same movement sequence of operating element 26 is thus necessary: initially a movement along first movement direction S1 and subsequently a movement along second movement direction S2.

During the movement of operating element 26 or slide 26, a force is effectuated by operating element 26 on pins 32, which acts in parallel to the plug-in direction and/or results in the plugging in or detaching of plug 12. Sections 34*a*, 34*b* of sliding track 30 act as a mechanical force transmission, in which a force on slide element 26 along movement directions S1, S2 is converted into the force parallel to plug-in direction R.

The transmission ratio of the force is dependent on the angle of sections 34*a*, 34*b* in relation to plug-in direction R (or the local angle at which pin 32 is located in sliding track 30).

The two sections 34*a*, 34*b* can be linear and can each have the same positive and negative angle in relation to plug-in direction R. It is also possible that the angle between section 34*b* and the straight line defined by direction R is greater than the angle between section 34*a* and this straight line. This can be advantageous if a large amount of force has to be applied at the end of the plugging procedure, in order to bring the plug contacts mechanically into contact. For example, if plug contacts 16, 18 are arranged in such a way that the plug contacts contact and are pushed one inside another from the middle position and a higher friction force thus has to be overcome.

In this case, a higher force transmission takes place in second section 34*b* than in first section 34*a*. If pin 32 is located in second section 34*b*, for example, an installer has to apply less operating force than with pin 32 in first section 34*a*, in order to generate the same plugging force between plug 12 and plug module 14. With the same operating force, the plugging force between plug 12 and plug module 14 is greater if pin 32 is located in second section 34*b*. Conversely, the ratio between actuating path and plugging path is less for second section 34*b* than in first section 34*a*. In other words, a relatively large amount of actuating path has to be covered for relatively little plugging path in second section 34*b* in comparison to first section 34*a*.

Slide 26 can be moved directly by an operator or can be moved via a lever, which can also be attached to housing 20 of plug 12, via a toothed rack.

Figure 2A:
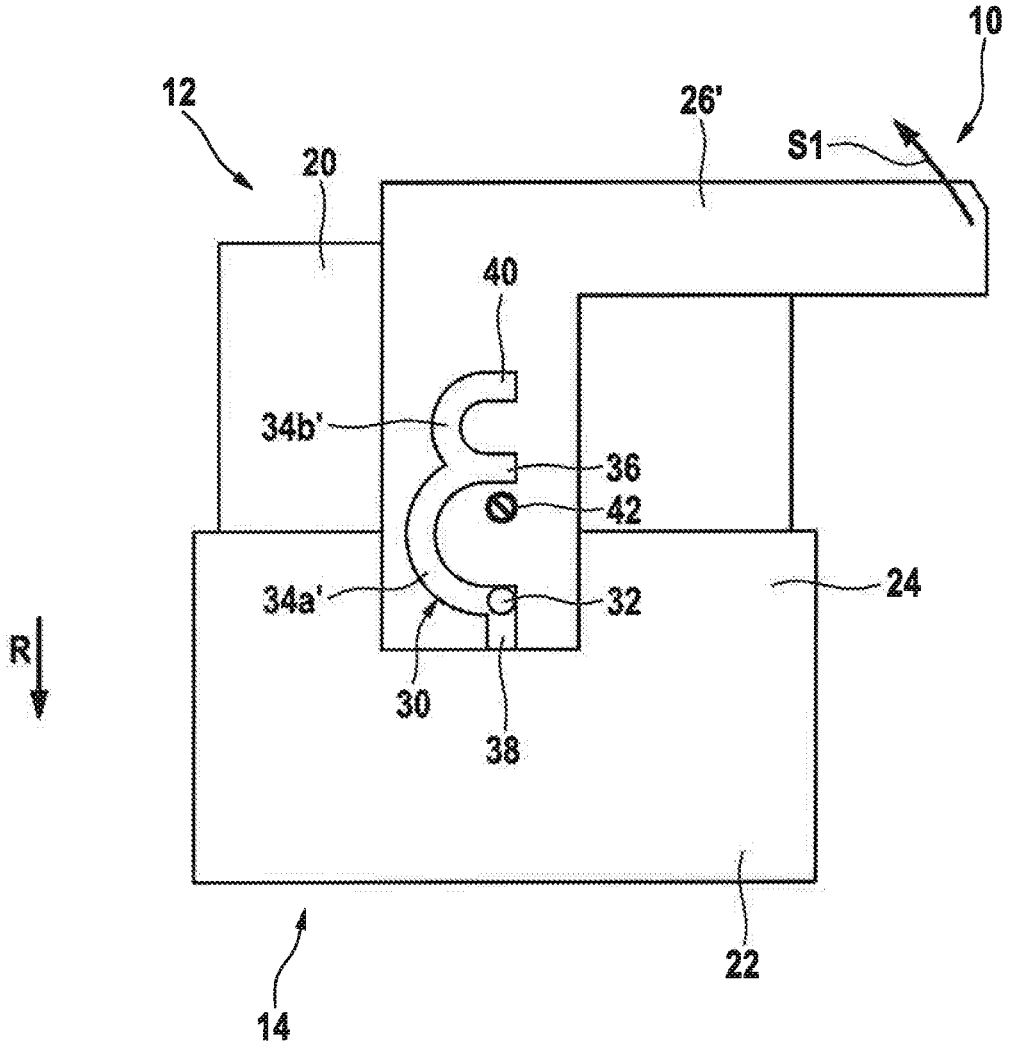
FIG. 2A schematically shows a side view of an electrical plug connection according to another example embodiment of the present invention in an applied position.
Figure 2B:
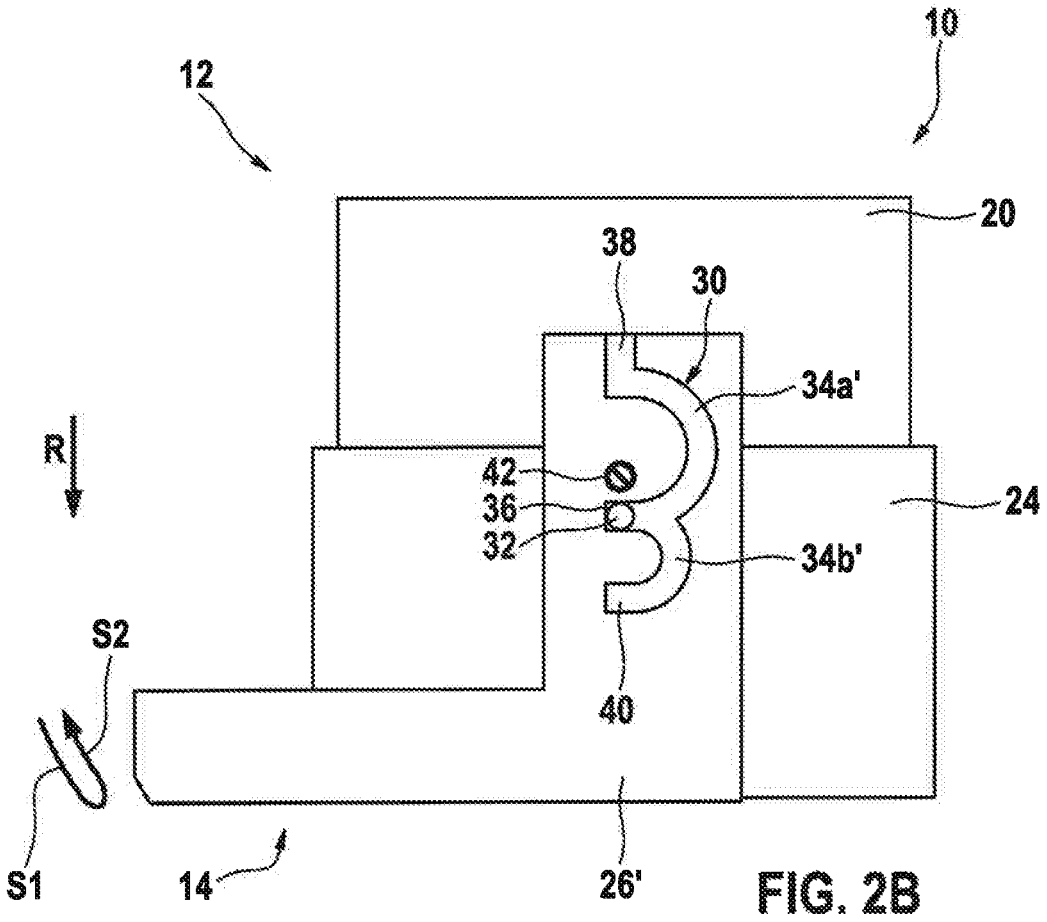
FIG. 2B schematically shows the electrical plug connection from FIG. 2A in a middle position, according to an example embodiment of the present invention.
Figure 2C:
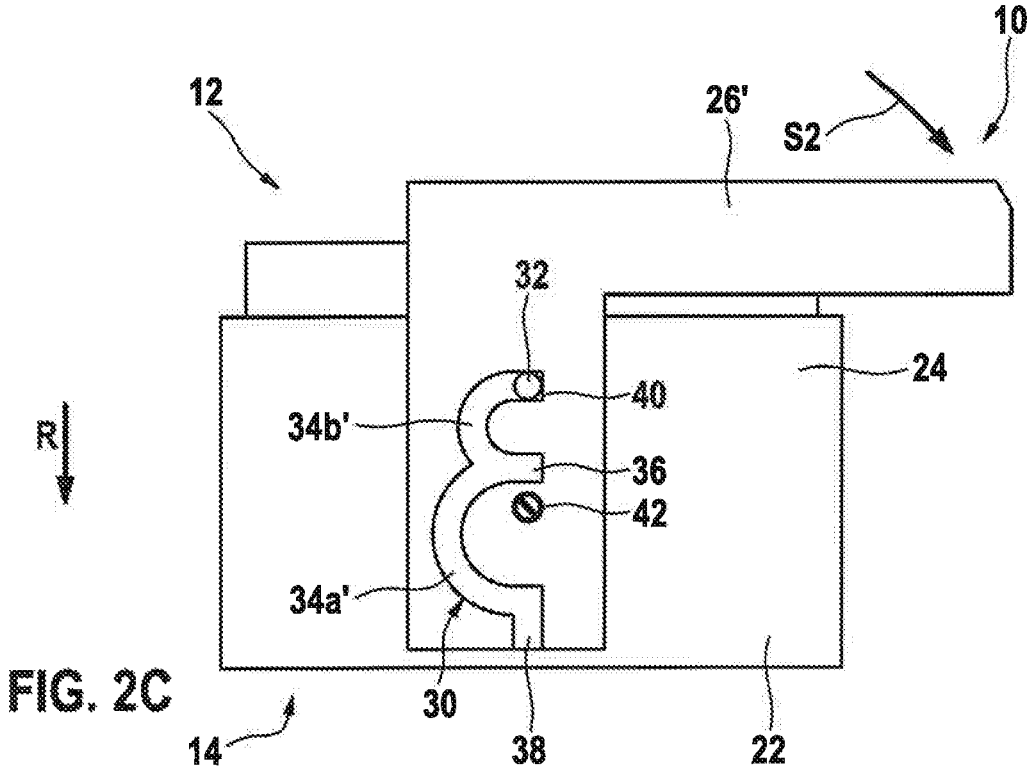
FIG. 2C schematically shows the electrical plug connection from FIG. 2A in a completely plugged position, according to an example embodiment of the present invention.

FIGS. 2A-2C show a plug connection 10 similar to FIGS. 1A-1C. However, plug connection 10 of FIGS. 2A-2C includes a lever 26' as operating element 26', which is attached around a rotational axis 42 on housing 20 of plug 12. Operating element 26' is thus fastened so it is movable (specifically rotatable) on housing 20 (specifically via rotational axis 24). Otherwise, plug connection 10 of FIGS. 2A-2C can include the same elements as that of FIGS. 1A-1C, in particular also plug contacts 16, 18.

Lever 26', which is located in an initial position in FIG. 2A, can be moved via a first movement S1 into a middle position and subsequently can be moved back into the initial position by an opposing movement. Plug 12 moves because of pin 32 running in sliding track 30 using the two sections 34*a*', 34*b*' in plug-in direction R from the applied position into the middle position and subsequently into the completely plugged-in position.

The force effect from lever 26' on pin 32 is dependent on a mechanical transmission ratio, which is determined by the distance of pin 32 in sliding track 30 in relation to rotational axis 42.

Sections 34*a*', 34*b*' can be curved having different radii of curvature, which results, for example, in an epsilon-shaped ("ε") or multiple-arc sliding track, as shown in FIGS. 2A-2C. Different transmission ratios can be set on pin 32 in different positions of lever 26' by different radii of curvature.

In contrast to the example embodiment shown in FIGS. 2A-2C, first section 34*a*' and second section 34*b*' can be curved in such a way that the distance of pin 32 from rotational axis 42, which is displaced during the plugging movement of plug 12 in relation to the pin along plug-in direction R, remains essentially the same. In this case, the mechanical transmission ratio between lever 26' and pin 32 remains essentially the same.

Similarly to FIGS. 1A-1C, the transmission ratio can also be selected in FIGS. 2A-2C in such a way that the force effect on pin 32 is elevated between the middle position and the completely plugged-in position (in relation to the force effect between the applied position and the middle position), to thus compensate for elevated friction.

In the present document, terms such as "having," "including," etc. do not exclude other elements or steps and terms such as "a" or "an" do not exclude a plurality.

What is claimed is:

1. An electrical plug connection comprising:

a plug that includes:

a housing that includes a plurality of electrical plug contacts; and an operating element that is moveably fastened onto the housing and that includes a sliding track;

a plug module that includes a plurality of complementary plug contacts, which, in a completely plugged-in position of the plug on the plug module, electrically contact the electrical plug contacts;

a pin attached to the plug module and that is guided in the sliding track, such that, during a movement of the operating element relative to the housing, a force is transmittable from the sliding track to the pin so that the plug and the plug module are movable toward each other in a plug-in direction and movable away from each other opposite to the plug-in direction, wherein the sliding track includes at least one first section and at least one second section oriented such that plugging of the plug into the plug module in the plug-in direction and detaching of the plug from the plug module opposite to the plug-in direction each is carried out by two movements of the operating element respectively in a first movement direction and in a second movement direction that is opposite the first movement direction, wherein the operating element is a lever that is rotatable relative to the housing of the plug.

2. The electrical plug connection of claim 1, wherein the operating element is designed in such a way that it exerts a first force on the pin in the first section during a movement in the first movement direction and it exerts a second force, which is oriented in the same direction as the first force, on the pin in the second section during a movement in the second movement direction.

3. The electrical plug connection of claim 1, wherein the first section of the sliding track and the second section of the sliding track are connected via a buckle in the sliding track.

4. The electrical plug connection of claim 1, wherein the operating element is a slide that is slidable in a slide direction relative to the housing of the plug.

5. The electrical plug connection of claim 4, wherein the slide direction extends transversely to the plug-in direction.

6. The electrical plug connection of claim 1, wherein the operating element includes a plurality of identically shaped sliding tracks.

7. The electrical plug connection of claim 1, wherein the first section and the second section are of different lengths.

8. A plug for an electrical plug connection, the plug comprising:

a housing that includes a plurality of electrical plug contacts; and an operating element that is moveably fastened onto the housing and that includes a sliding track in which a pin is guidable, wherein the operating element is a lever that is rotatable relative to the housing of the plug, wherein the sliding track includes at least one first section and at least one second section oriented such that plugging of the plug into a plug module in a plug-in direction and detaching of the plug from the plug module opposite to the plug-in direction each is carried out by two movements of the operating element respectively in a first movement direction and in a second movement direction that is opposite the first movement direction.

9. The electrical plug connection of claim 1, wherein:

the first section and the second section are curved in an arc shape, the first movement direction is a first rotation of the operating element in one of a clockwise direction and a counterclockwise direction in which the pin moves from an initial position at an entrance of the sliding track to an intermediate position that is displaced from the entrance along the sliding track, and the second movement direction is a second rotation of the operating element in another one of the clockwise direction and the counterclockwise direction in which the pin moves to a further position within the sliding track that is further from the entrance than is the intermediate position.

10. The plug as recited in claim 8, wherein:

the at least one first section is at least one first curved section, the at least one second section is at least one second curved section in communication with the at least one first curved section, when the pin is engaged in an entrance of the sliding track:

a first rotation of the operating element in one of a clockwise direction and a counterclockwise direction causes the pin to be moved away from the entrance along the sliding track, and a second rotation of the operating element in another one of the clockwise direction and the counterclockwise direction causes the pin to continue moving farther away from the entrance along the sliding track.

* * * * *